United States Patent [19]

Leonard, Jr.

[11] 4,184,869

[45] Jan. 22, 1980

[54] METHOD FOR USING FLUX AND SLAG DEOXIDIZER IN ESR PROCESS

[75] Inventor: Regis J. Leonard, Jr., Coopersburg, Pa.

[73] Assignee: Bethlehem Steel Corporation, Bethlehem, Pa.

[21] Appl. No.: 947,139

[22] Filed: Sep. 29, 1978

[51] Int. Cl.[2] ..... C22B 4/00

[52] U.S. Cl. ..... 75/10 C; 75/10 R

[58] Field of Search ..... 75/10 R, 10 C; 148/26

[56] References Cited

U.S. PATENT DOCUMENTS

| | | | |
|---|---|---|---|
| 3,841,923 | 10/1974 | Dudko | 148/26 |
| 3,857,702 | 12/1974 | Corbett | 75/257 |
| 3,950,163 | 4/1976 | Nafziger | 75/257 |
| 3,997,332 | 12/1976 | Nafziger | 75/10 R |
| 4,061,493 | 12/1977 | Jaeger | 75/10 C |

FOREIGN PATENT DOCUMENTS

| | | | |
|---|---|---|---|
| 979583 | 1/1965 | United Kingdom | 75/10 R |

OTHER PUBLICATIONS

"Potential of Electroslag," Metals, pp. 44–49 (Mar., 1967).

*Primary Examiner*—P. D. Rosenberg

*Attorney, Agent, or Firm*—Joseph J. O'Keefe; William B. Noll

[57] ABSTRACT

A method of controlling contamination of, and alloy variations in the remelted product of an electro-slag refining (ESR) or remelting process. More particularly, this invention is directed to a slag forming flux, to the timing and/or manner in which the flux is utilized during such method, and to a slag deoxidizer. The controls are achieved by the sequential additions of a (1) flux of predominantly $CaF_2/Al_2O_3$ with the balance a mixture of $SiO_2$ and MnO, and (2) a non-aluminum containing slag deoxidizer such as CaSi. Preferably, the flux is added in two portions about one-third at start-up with the remainder after the start-up portion has melted to form a slag blanket. As a preferred alternative, the total amount of $SiO_2/MnO$ of the flux is added with the start-up portion and the remainder portion comprises essentially only $CaF_2/Al_2O_3$.

8 Claims, No Drawings

METHOD FOR USING FLUX AND SLAG DEOXIDIZER IN ESR PROCESS

BACKGROUND OF THE INVENTION

The present invention relates to an electro-slag refining (ESR) or remelting process and more particularly, a method for utilizing and deoxidizing the slag to control contamination of and alloy variations in the remelted product of such process. Such method was developed principally for remelting and refining high strength alloy steels designated for critical high temperature applications, such as turbine rotor shafts, etc. Experience had shown that high residual aluminum in the alloy steels, in excess of 0.008 to 0.010%, by weight, caused such steels to fail by creep rupture. Thus, a primary aim of the research leading to the development of this invention was to devise a slag system for an ESR process that would control aluminum contamination, while avoiding other pitfalls, such as hydrogen and oxygen pickup, and alloy fade or variations in the remelted alloy steel ingot.

Though ESR has been known and practiced for years, the sophisticated nature of the metals involved, and the critical applications therefore, called for special considerations.

According to the description by Duckworth and Hoyle in Electro-slag Refining, published in 1969 by the British Iron & Steel Research Association, ESR is a secondary refining process for metal, using as its raw materials a solid consumable electrode of such metal in the form of a wrought or cast ingot, or scrap. The ESR process uses a molten slag bath for melting said electrode. The slag bath, contained in a cooled mold, is resistance heated, melted, and maintained in a molten condition by an electric current flowing between said electrode and a cooled base. As the temperature of the slag bath rises above the melting point of the electrode metal, droplets melt off the tip of the submerged electrode, fall through the slag bath, and collect in a pool on the base to solidify. The electrode is continuously fed into the slag bath, and an ingot, the remelted product of said electrode metal, which now acts as the secondary electrode is progressively built up. With such buildup, the molten slag is continuously displaced in an upward direction.

Since development of the ESR process prior to WWII by Robert Hopkins, activity therein has remained low key even though the interest has been quite keen. As a result there is considerable published literature and world-wide patents directed to ESR and to improvements thereof.

By way of example, U.S. Pat. No. 4,061,493, to Jaeger, relates to a process to improve the purity of the remelted product (ingot) of an ESR process. This is achieved in the ESR process by the steps which include melting at least one self consuming electrode with alternating current in a liquefied electrically conductive slag. Concurrently, superimposed currents are generated in the ESR slag by means of at least two differently poled non-melting auxiliary electrodes connected to at least one d.c. source (1) between the auxiliary electrodes and the remelting electrode, and (2) the auxiliary electrodes and the ingot. This results, by utilization of fusion electrolysis, in a migration of the undesirable elements, i.e. $H_2$ and $O_2$, present in the form of ions, to the auxiliary electrodes and the removal thereof from the melt.

Another aspect of ESR which has received interest is the field of fluxes, the slag forming ingredients. U.S. Pat. No. 3,950,163, to Nafziger, teaches the use of a quaternary flux for ESR to lower the liquidus temperature of the slag while maintaining its electrical resistivity. Such a flux comprises $CaF_2$, CaO, MgO and $Al_2O_3$.

U.S. Pat. No. 3,857,702, to Corbett, teaches an ESR flux formed from particulate batch materials providing at least alumina, a fluoride and alkaline earth metal oxide, including calcium oxide, and the process to minimize the presence of free CaO, by which such flux is made. An exemplary flux taught by Corbett comprises 40% $CaF_2$, 30% CaO, and 30% $Al_2O_3$, with free calcium oxide being less than 1.5%.

Typically among such prior art ESR practices, and particularly the fluxes used therein, a common fact appears—the use of a single flux, from start-up through melting. In contrast to this, the preferred embodiment of the present invention employs an essentially two flux system with slag deoxidation. The timing and/or manner in which the two fluxes are utilized in the preferred practice of this invention, and the manner in which the slag is deoxidized will be described in greater detail hereinafter.

SUMMARY OF THE INVENTION

This invention is directed to a method of controlling contamination of, and alloy variations in the remelted product or ingot of an ESR process. More particularly, this invention relates to the use of a low liquidus temperature, acid slag system to eliminate pickup of oxygen, hydrogen, and aluminum in said ingot, while minimizing alloy variations in such ingot. The advantages to be gained by said method are achieved by the sequential additions of a (1) flux of predominantly $CaF_2/Al_2O_3$ with the balance a mixture of $SiO_2$ and MnO, and (2) non-aluminum containing slag deoxidizer such as CaSi.

DETAILED DESCRIPTION OF PREFERRED EMBODIMENT

The present invention relates to a method of controlling contamination of, and alloy variations in the remelted product or ingot of an electro-slag remelting (ESR) or refining process. Though ESR is a metal refining practice known throughout the world, a brief review thereof may be helpful to a fuller understanding of the present invention.

In an ESR process, melting of one or more consumable electrodes is accomplished in a water cooled furnace. A typical furnace comprises vertical walls, and a bottom base plate upon which the resulting product or ingot solidifies. To start the process, an arc is struck between the electrode(s) and a button or chips of the metal to be melted on the furnace base plate. Powdered flux, previously added to cover the base plate, melts to form a pool of molten slag. The molten slag becomes conductive and extinguishes the arc. From this point on, electrical current is changed to heat. As the electrode(s) is submerged within the molten slag, molten droplets form along the bottom side or submerged tip of the electrode(s), separate from it, pass through the molten slag, and collect in a pool at the bottom of the furnace. After melting of the electrode(s) is initiated, additional flux may be added to develop the full slag bath. Solidification of the new ingot occurs as heat is withdrawn from the bottom of the ingot and from the side via the water cooled furnace producing uniform upward solidification.

A metallurgically sound ingot depends on many factors, typically among them, though not limiting, are the rate of melting, heat transfer rate, solidification rate, and most importantly the molten slag bath.

The primary requirements of an ESR slag are (1) that it should be molten at a temperature preferably slightly below that of the metal to be remelted and refined, and, that it be stable at the operating temperatures of the process, i.e. up to about 900° F. (500° C.) above the melting point of said metal, (2) that it be electrically conducting in the molten state, (3) that it be fluid at operating temperatures, and (4) that it have a low volatility. Additional criteria are those of thermal conductivity, thermal capacity, surface tension, and the ability to scavenge undesirable elements which might otherwise end up in the resulting product or ingot.

A particularly undesirable element, for the types of steels produced by the ESR process, is hydrogen. Hydrogen pickup occurs as a result of these reactions:

$$H_2O+(O^{2-})\rightarrow 2\,(OH)^-$$

$$(OH)^-+[Fe]\rightarrow(FeO)+[H],$$

where ( ) indicates a species in the slag phase, and
[ ] indicates a species in the metal phase Obviously, two routes are available to minimize hydrogen pickup in the solidified ingot—(1) atmosphere or humidity control of melting facilities to eliminate $H_2O$, and (2) eliminate the free oxygen ions ($O^{2-}$) in the slag. The present invention follows the latter route.

However, like many scientific procedures, different problems can arise when attempting to solve a given problem. For example, with low ($O^{2-}$) slags containing mainly $CaF_2$ and $Al_2O_3$ there is the tendency to produce a slag having a high liquidus temperature. With higher liquidus temperature slags there is a drastic reduction in the temperature difference between the operating temperature and liquidus temperature. As such difference decreases, there is a corresponding increase in the thickness of the solidified slag layer which develops about the ingot. Such layer tends to insulate the ingot such that only a relatively thin ingot skin is initially solidified. With a movable ingot ESR operation, i.e. where the solidifying ingot is withdrawn from the furnace bottom, internally the ingot is not solidified. As a consequence, the insulated thin skin of the ingot may break permitting the molten metal therein to run out.

A second problem encountered with low ($O^{2-}$) slags is a high activity of FeO. Through extensive investigation there has been found a direct relationship between the FeO activity of the slag and the oxygen content of the ingot. Also, the nature of the slag has an influence on the FeO activity. That is, for a given FeO content, an acid slag will have a greater FeO activity than a basic slag having the same FeO content. In any event, to reduce the FeO activity requires deoxidation of the slag. And, more deoxidant is required for an acid slag (for example 70/30 $CaF_2/Al_2O_3$) than a basic slag (for example 60/20/20 $CaF_2/CaO/Al_2O_3$). This greater amount of deoxidant, where aluminum is the deoxidant, runs the risk of introducing aluminum to the ingot. Clearly then, a carefully balanced slag system is critical to achieve an ingot essentially free of contamination by oxygen, hydrogen and aluminum. "Slag system," as used herein, is intended to include the flux ingredients which form the slag bath of the ESR process, and the slag deoxidizer which enters said bath, combines with oxygen and becomes an integral part of such bath.

The specially designed flux and slag deoxidant of the present invention not only satisfies the above requirements and has characteristics which satisfy the additional criteria, but it provides unexpected benefits. Such slag system deoxidizes the slag during electroslag remelting to limit the hydrogen and oxygen content of the remelted product or ingot, and by its use prevents the introduction of undesirable elements, such as aluminum, into the ingot. Finally, such a system drastically limits the steady loss of manganese from the ingot. The latter may be termed, "manganese fade."

All of the positive benefits above are the result and timely use of a (1) flux and (2) slag deoxidizer. The flux comprises predominantly $CaF_2$ and $Al_2O_3$, with up to about 10%, by weight of a mixture of MnO and $SiO_2$. The ratio of $SiO_2$ to MnO is preferably between about 5 and 1.5 to 1. An optimum mix is one having a ratio of about 2 to 1. Preferably, the flux is added in two portions, about one third at start-up with the remainder added after the start-up portion has melted to form a slag blanket. As a preferred alternative, the total amount of $SiO_2$/MnO of the flux, i.e. up to about 30% by weight of such first portion, is added as the start-up portion and the remainder portion, comprising essentially only $CaF_2/Al_2O_3$, is added after the start-up portion is melted.

The slag deoxidizer, i.e. a material that is essentially continuously fed to the slag bath during the melting and solidifying process, comprises preferably CaSi containing nominally, by weight, 30% calcium, 65% silicon and up to about 5% iron and trace impurities. It was discovered that CaSi was as effective as aluminum for deoxidation of ESR slags but did not introduce undesirable elements into the ingot. Calcium, with its very strong deoxidation potential is virtually insoluble in steel. On the other hand, silicon is not an undesirable element in steel, and the silicon's accumulation in the slag helps prevent loss of Si from the ingot. Though CaSi was found to be an effective slag deoxidizer, it was soon discovered during the development of this invention that an increase in the $SiO_2$ content of the slag, as the CaSi is oxidized, resulted in reaction with steel which caused manganese to be oxidized. This resulted in a severe manganese loss of as much as 0.15%, by weight, from the manganese level in the electrode(s). It was further discovered that adding MnO to the flux, such that the ratio therein between $SiO_2$ and MnO was between about 5 and 1.5 to 1, would limit the steady loss of manganese from the ingot during melting as CaO and $SiO_2$ accumulate in the slag.

As a result of this discovery, the flux of $CaF_2$ and $Al_2O_3$, in a ratio of between 2 and 3 to 1, preferably in the ratio of 2.33/1 (typically given as 70/30), was modified by the inclusion of a mixture of up to 10%, by weight, of MnO and $SiO_2$. Since, as noted in the preferred embodiment above, only a portion of the flux (typically about one-third) is added during start-up of the ESR process, the initial flux charge to the furnace may be enriched to include all of the $SiO_2$/MnO mixture. Thus, the flux may be considered in two portions, the first comprising $CaF_2/Al_2O_3$ with up to 30% $SiO_2$/MnO, and the second, $CaF_2/Al_2O_3$. The use of the preferred flux according to the practice of this invention will be described in greater detail hereinafter.

As noted previously, to start the ESR process, an arc is struck between the electrode(s) and a button or chips of the metal to be refined placed on the furnace base plate. Powdered flux, in the present case the $SiO_2/MnO$ enriched flux ($CaF_2/Al_2O_3$), is added to the furnace. As such enriched flux is melted it becomes conductive and extinguishes the arc. In the meantime the submerged electrode(s) begins to melt. At such time as the enriched flux is fully molten, such molten flux or slag is supplemented by additional flux, namely, $CaF_2/Al_2O_3$. As the electrode(s) melting proceeds, a slag deoxidizer of CaSi is essentially continuously fed to the furnace.

Earlier it was indicated that operating problems can arise with slags having a high liquidus temperature. The slag system of this invention, during all stages of the ESR process, exhibits a relatively low liquidus temperature as compared to a standard 70/30 ($CaF_2/Al_2O_3$) slag (Table I). Laboratory measurements of viscosity, as a function of temperature, for various ESR slags were plotted. The sharp breaks in the plotted curves corresponded to crystallization in the melt. Recognizing that the exact temperature of the break may vary with cooling rate, the reported temperatures are listed as "apparent liquidus temperature" (A.L.T.). Following a preferred practice of this invention, i.e. adding all the $SiO_2/MnO$ in the initial portion of the flux change, resulted in the lowest A.L.T., namely 2415° F. (1484° C.).

TABLE I

| | Slag System | | | | | | A.L.T. of (°C.) |
|---|---|---|---|---|---|---|---|
| | $CaF_2$ | CaO | $Al_2O_3$ | $SiO_2$ | MnO | FeO | |
| 1 | 70 | — | 30 | — | — | | 2703 (1484) |
| 2* | 57 | — | 24 | 12 | 7 | | 2415 (1324) |
| 3* | 65 | — | 28 | 5 | 2 | | 2582 (1417) |
| 4* | 53 | 9 | 25 | 11 | 1.5 | 0.5 | 2469 (1354) |

2* Initial flux charge of invention slag
3* Initial flux charge and balance of invention slag (full slag charge) before slag deoxidation
4* Final invention slag after CaSi deoxidation To demonstrate the effectiveness of the slag system of this invention, five 40" diameter ingots, varying in weight between about 10 tons and about 24 tons, were refined according to an ESR process using different flux and slag deoxidizers.

TABLE II

| Heat (ingot wt.-lbs.) | Flux Ingredients | Flux Proportions (wt.-lbs.) | Deoxidizer* (wt.-lbs.) |
|---|---|---|---|
| A (26,300) | $CaF_2/CaO/Al_2O_3$ | 60/20/20 (1245) | None |
| B (19,380) | $CaF_2/CaO/Al_2O_3$ | 60/20/20 (1150) | Ti (18.8) |
| C (31,200) | $CaF_2/Al_2O_3 + SiO_2$ | 70/30 + 5% (1325) | Ti (74.4) |
| D (27,900) | $CaF_2/Al_2O_3 + SiO_2$ | 70/30 + 4% (1325) | Si (35.6) |
| E (48,600) | $CaF_2/Al_2O_3 + SiO_2 + MnO$ | 70/30 + 5% + 2 (1325) | CaSi (59.4) |

*quantity of deoxidizer for Heats B to E is the amount of the particular deoxidizer needed to limit the FeO content of the slag at a level no greater than 0.5%

TABLE III

| | Electrode(s) Chemistry %* | | | | | | | | | |
|---|---|---|---|---|---|---|---|---|---|---|
| Heat | C | Mn | P | S | Si | Ni | Cr | V | Mo | Al |
| A | .32 | .71 | .008 | .005 | .21 | .56 | 1.00 | .22 | 1.29 | <.005 |
| B | .33 | .97 | .013 | .013 | .30 | .15 | 1.07 | .22 | 1.16 | <.005 |
| C | .31 | .72 | .014 | .008 | .29 | .40 | 1.04 | .22 | 1.24 | <.005 |

TABLE III-continued

| | Electrode(s) Chemistry %* | | | | | | | | | |
|---|---|---|---|---|---|---|---|---|---|---|
| Heat | C | Mn | P | S | Si | Ni | Cr | V | Mo | Al |
| D | .27 | .69 | .012 | .012 | .26 | .40 | 1.04 | .22 | 1.15 | <.005 |
| E | .31 | .70 | .008 | .006 | .30 | .46 | 1.21 | .26 | 1.29 | <.005 |

*all heats were vacuum degassed resulting in less than 2 ppm hydrogen

TABLE IV

| | Ave. Ingot Chemistry % (Partial) | | | | |
|---|---|---|---|---|---|
| Heat | Mn | Si | Al | $H_2$ (ppm) | $O_2$ (ppm) |
| A | .60 | .07 | .007 | 6.3 | 20 |
| B | .94 | .22 | <.005 | 7.8 | 20 |
| C | .63 | .24 | <.005 | 1.3 | 12 |
| D | .59 | .29 | <.005 | 1.7 | 14 |
| E | .70 | .29 | <.005 | 1.5 | 14 |

The 60/20/20 flux of Heat A, without deoxidant, was particularly ineffective. It will be noted that there was a severe loss of both manganese and silicon, with a concurrent pickup in hydrogen. With the addition of a titanium deoxidant, Heat B, the manganese content stabilized. However, silicon dropped and hydrogen remained unacceptably high.

Changing the slag system to 70/30 plus $SiO_2$ and titanium deoxidant, Heat C, reduced the hydrogen pickup in the ingot. A manganese loss was noted while some loss in silicon was found. It was also discovered that titanium deoxidation leads to melt instability in 70/30 systems. For example, very high temperatures and low melting rates were observed. It was theorized that such instability was due to the formation of electrically conducting refractory titanates.

In Heat D the silicon loss was corrected. The addition of $SiO_2$ to the initial flux lowered the liquidus temperature of the slag, thus reducing the potential for a breakout, but it also aggrevated the manganese fade. Further, with Heat E, using the slag system of this invention, alloy losses in the ingot were essentially eliminated and the hydrogen level therein was maintained at an acceptable level below about 2 ppm. Finally, Table IV also shows that the oxygen content of all the ingots were at acceptable low levels.

I claim:

1. A method of electroslag melting a consumable electrode in a furnace having a cooled base and side walls to contain at least the initial melted product of said consumable electrode, said product being a ferrous alloy sensitive to hydrogen pickup and containing less than about 0.005%, by weight, aluminum, comprising the steps of establishing a layer of flux on said base, said flux comprising a mixture of $CaF_2$ and $Al_2O_3$ with up to 10%, by weight, of a mixture of $SiO_2$ and MnO, where the ratio of $SiO_2/MnO$ varies between 5 and 1.5 to 1, melting said flux through resistance heating by means of an electric current flowing between said consumable electrode and said cooled base to form a pool of molten slag, introducing said consumable electrode into said pool of molten slag, melting said consumable electrode forming a pool of molten metal below said pool of molten slag, continuing the melting of said consumable electrode, and concurrent with the melting of said consumable electrode conditioning the pool of molten slag by the addition of a slag deoxidizer consisting essentially of CaSi, whereby the combination of said flux and said slag deoxidizer acts to minimize hydrogen and aluminum pickup in said product.

2. The method according to claim 1 wherein the flux is added to said furnace in two portions, where the first portion contains all of the $SiO_2$and MnO and the second portion consists essentially of only $CaF_2$ and $Al_2O_3$.

3. The method according to claims 1 or 2 wherein the quantity of slag deoxidizer added to the pool of molten slag is sufficient to limit the FeO content of said molten slag at a level no greater than 0.5%, by weight.

4. The method according to claims 1 or 2 wherein the $CaF_2$ and $Al_2O_3$ is present in a ratio of between about 2 and 3 to 1.

5. The method according to claim 4 wherein the $CaF_2/Al_2O_3$ ratio is about 2.33/1.

6. The method according to claims 1 or 3 wherein the liquidus temperature of said molten slag is less than about 2703° F. (1484° C.).

7. A method of electroslag melting a consumable electrode in a furnace to form a ferrous alloy ingot sensitive to hydrogen pickup and containing less than about 0.005%, by weight, aluminum, comprising the steps of establishing a pool of molten acid slag therein and composed of $CaF_2$, $Al_2O_3$, $SiO_2$ and MnO, and concurrent with the melting of said consumable electrode adding to said pool of molten slag a slag deoxidizer consisting essentially of CaSi to minimize pickup of residual aluminum and hydrogen in said ingot.

8. The method according to claim 7 wherein the liquidus temperature of said molten acid slag is less than about 2703° F.(1484° C.).

* * * * *